US008219390B1

(12) United States Patent
Laroche

(10) Patent No.: US 8,219,390 B1
(45) Date of Patent: Jul. 10, 2012

(54) PITCH-BASED FREQUENCY DOMAIN VOICE REMOVAL

(75) Inventor: Jean Laroche, Santa Cruz, CA (US)

(73) Assignee: Creative Technology Ltd, Singapore (SG)

( * ) Notice: Subject to any disclaimer, the term of this patent is extended or adjusted under 35 U.S.C. 154(b) by 774 days.

(21) Appl. No.: 10/663,446

(22) Filed: Sep. 16, 2003

(51) Int. Cl.
*G10L 11/04* (2006.01)

(52) U.S. Cl. ..... 704/207; 704/208; 704/209; 704/214; 704/216; 704/217

(58) Field of Classification Search ..... 704/205, 704/207, 208, 209, 214, 216, 217
See application file for complete search history.

(56) References Cited

U.S. PATENT DOCUMENTS

| | | | | |
|---|---|---|---|---|
| 4,328,579 | A * | 5/1982 | Hashimoto et al. | 370/210 |
| 6,018,706 | A * | 1/2000 | Huang et al. | 704/207 |
| 6,049,766 | A * | 4/2000 | Laroche | 704/216 |
| 6,148,086 | A * | 11/2000 | Ciullo et al. | 381/106 |
| 6,182,042 | B1 * | 1/2001 | Peevers | 704/269 |
| 6,405,163 | B1 | 6/2002 | Laroche | 704/205 |
| 6,931,377 | B1 * | 8/2005 | Seya | 704/277 |
| 2004/0193407 | A1 * | 9/2004 | Ramabadran et al. | 704/207 |

FOREIGN PATENT DOCUMENTS

WO WO 01/24577 A1 4/2001

OTHER PUBLICATIONS

Carlos Avendano and Jean-Marc Jot: *Ambience Extraction and Synthesis from Stereo Signals for Multi-Channel Audio Up-Mix*; vol. 11—1957-1960: ©2002 IEEE.

Jean-Marc Jot and Carlos Avendano: *Spatial Enhancement of Audio Recordings; AES 23rd* International Conference, Copenhagen, Denmark, May 23-25, 2003.

U.S. Appl. No. 10/163,158, filed Jun. 4, 2002, Avendano et al.

U.S. Appl. No. 10/163,168, filed Jun. 4, 2002, Avendano et al.

* cited by examiner

*Primary Examiner* — Leonard Saint Cyr
(74) *Attorney, Agent, or Firm* — Creative Technology Ltd

(57) ABSTRACT

A system and method are disclosed for modifying an audio signal. A pitch associated with the audio signal is detected. A portion of the audio signal that is associated with the detected pitch is modified. Controlling the modification of a primary audio signal is disclosed. The level of a secondary audio signal is monitored. Modification of the primary audio signal is enabled if the level of the secondary audio signal rises above a first prescribed threshold at a time when the primary audio signal is not being modified. Modification of the primary audio signal is disabled if the level of the secondary audio signal drops below a second prescribed threshold at a time when the primary audio signal is being modified.

61 Claims, 13 Drawing Sheets

PITCH-BASED FREQUENCY DOMAIN VOICE REMOVAL

INCORPORATION BY REFERENCE

U.S. Pat. No. 6,405,163, entitled PROCESS FOR REMOVING VOICE FROM STEREO RECORDINGS, issued Jun. 11, 2002, is incorporated herein by reference for all purposes.

FIELD OF THE INVENTION

The present invention relates generally to digital signal processing. More specifically, pitch-based frequency domain voice removal is disclosed.

BACKGROUND OF THE INVENTION

This disclosure relates to voice removal techniques. Such techniques may be useful in a variety of applications, including the now very popular field of karaoke entertaining. In karaoke a (usually amateur) singer performs live in front of an audience with background music. One of the challenges of this activity is to come up with the background music (i.e. get rid of the original singer's voice to retain only the instruments so the amateur singer's voice can replace that of the original singer).

One way in which this can be achieved consists of using a stereo recording and making the assumption (usually true) that the voice is panned in the center (i.e., that the voice was recorded in mono and added to the left and right channels with equal level). In that case the voice can be significantly reduced by subtracting the right channel from the left channel (referred to herein as the "left minus right" technique), resulting in a mono recording from which the voice is nearly absent. Using this approach, a faint reverberated version of the voice typically is left in the difference signal because stereo reverberation is usually added after the mix. There are several drawbacks to this technique. First, the output signal is always monophonic. In other words it is not possible using this technique to recover a stereo signal from which the voice has been removed. Second, more often than not, other instruments are also panned in the center (bass guitar, bass drum, horns and so on), and the left minus right technique will also remove them, which is undesirable.

U.S. Pat. No. 6,405,163 (the '163 Patent), incorporated by reference above, describes another method which comprises applying a gain to the left and right channels in the short time frequency domain to attenuate center-panned signals. The frequency domain processing method improves on the left minus right technique in that it outputs a stereo signal. While the techniques described in the '163 Patent provide better results than the left minus right approach, the techniques taught by the '163 Patent may result in center-panned signals other than the voice being removed. For example, as noted above percussion, bass, and other instruments are sometimes panned to the center. The '163 Patent teaches restricting the attenuation to voice frequencies in an effort to avoid removing non-voice components. However, the voice spectrum overlaps with the frequency spectra of many instruments that might also be center panned (for example, guitars and snare drums), and components associated with such instruments may also be removed under the approaches taught in the '163 Patent. Therefore, there is a need for a way to remove a center-panned voice component without also removing components associated with other center-panned signals, including signals in the voice frequency range.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

It should be appreciated that the present invention can be implemented in numerous ways, including as a process, an apparatus, a system, or a computer readable medium such as a computer readable storage medium or a computer network wherein program instructions are sent over optical or electronic communication links. It should be noted that the order of the steps of disclosed processes may be altered within the scope of the invention.

A detailed description of one or more preferred embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Removing or amplifying one or more components from a stereo recording is disclosed. In one embodiment, short time frequency domain techniques are used to selectively apply a gain to one or more frequency bins associated with one or more pitches. This approach allows center-panned signal components other than voice, including those at voice frequencies, to be preserved in the final output. In one embodiment, pitch estimation is used to selectively modify only the harmonics of the voice component.

The idea behind pitch-based processing is that measuring the pitch (or the pitches) of the signal can help discriminate the voice component from other audio components. For example, drum hits are not pitched, and bass-guitar notes might have a pitch much lower than a singer's pitch. If the voice pitch can be identified, harmonics of the fundamental frequency of the voice component can be modified and the remaining components of the audio signal can be preserved.

Figure 1:
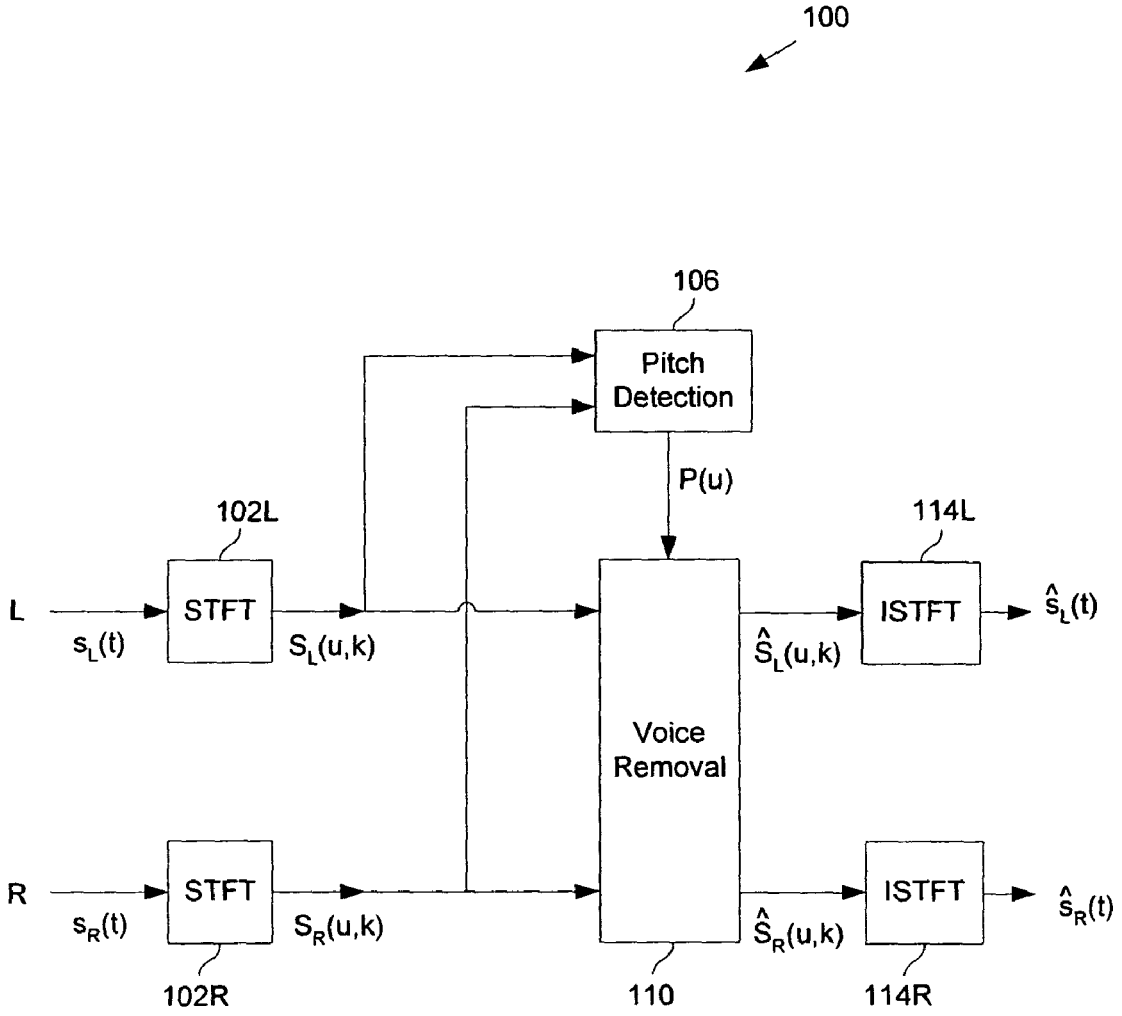
FIG. 1 is a block diagram illustrating a system used in one embodiment to remove or amplify one or more components from a stereo recording.

FIG. 1 is a block diagram illustrating a system used in one embodiment to remove or amplify one or more components from a stereo recording. As used herein, the term "component" refers to a portion of an audio signal that is associated with an identifiable audio source, such as the voice of a particular singer or the output of an instrument. The term "audio signal" as used herein refers to any set of audio data stored or transmitted in any form, including without limitation a sound recording. FIG. 1 shows a left stereo channel $s_L(t)$ and a right stereo channel $s_R(t)$ being provided as inputs to short time Fourier transform (STFT) blocks 102L and 102R, respectively. In one embodiment, the left and right stereo channels may be in the form of digital signals. For analog stereo channels, the channels can be digitized using techniques well known in the art. The outputs of STFT blocks 102L and 102R are the frequency domain spectra of the left and right stereo channels, labeled in FIG. 1 as $S_L(u,k)$ and $S_R(u,k)$, respectively. In one embodiment, u and k are discrete time and frequency indexes, respectively (e.g., u is the frame index and $\omega=2\pi k/N$ where $\omega$ is the frequency and N is the size of the STFT). In one embodiment, STFT blocks 102L and 102R have frame sizes that include several periods of the voice signal (for example, 30-60 ms). In one embodiment, each frame overlaps the previous frame. In general, the STFT blocks may be implemented or replaced by other blocks that perform a similar function. In one embodiment, STFT blocks 102L and 102R may comprise subband filter banks. In one embodiment, STFT blocks 102L and 102R may perform wavelet transforms.

The outputs of STFT blocks 102L and 102R are provided as input to a pitch detection block 106. Pitch detection block 106 detects the pitch of the voice information in the signal using one of many methods well known in the art. In one embodiment, it is assumed that the voice component typically will be associated with the most prominent pitch associated with the audio signal, and in one such embodiment pitch detection block 106 is configured to detect the most prominent pitch in each portion of the audio signal. Pitch detection block 106 provides as output for each frame u a most-prominent pitch value P(u). The outputs of pitch detection block 106 and STFT blocks 102L and 102R are provided as inputs to voice removal block 110.

As used herein, the term "remove" refers to any degree of attenuation of the affected component, including without limitation either full or partial attenuation of the affected component. While voice removal block 110 is labeled "voice removal", those of skill in the art will recognize that the component removed may be other than voice. In one alternative embodiment, voice removal block 110 may be configured to amplify instead of remove the affected component(s).

Voice removal block 110 selectively modifies portions believed to be voice-related based on the output of pitch detection block 106. In one embodiment, portions are identified as potentially voice-related if they are associated with a most-prominent pitch detected by pitch detection block 106. In one embodiment, selectively modifying comprises calculating a gain and selectively applying the gain. In one such embodiment, the gain is zero for center-panned portions identified as potentially voice-related based on the output of pitch detection block 106 and nonzero (e.g., one) for other portions (voice removal). Alternatively, the gain may be greater than one for center-panned portions identified as potentially voice-related based on the output of pitch detection block 106 and one for other portions (voice amplification). In one embodiment, as described more fully below, the gain may vary based on the degree of similarity between the left and right channels and/or other factors.

Voice removal block 110 provides as output modified frequency domain spectra $\hat{S}_L(u,k)$ and $\hat{S}(u,k)$ for the left and right channels, respectively. In one embodiment, the modified spectra comprise the original spectra as modified by applying the gains described above. The modified frequency domain spectra are provided as input to inverse short time Fourier transform (ISTFT) blocks 114L and 114R, respectively. ISTFT blocks 114L and 114R are configured to synthesize modified time-domain signals $\hat{s}_L(t)$ and $\hat{s}_R(t)$, respectively. If voice removal block 110 attenuated components of the signal panned to the center at the pitch believed to be voice, the modified stereo channels output by ISTFT blocks 114L and 114R will have voice removed. However, the instruments and other sounds not panned to the center and/or not at the pitch believed to be voice will be preserved.

In one embodiment, voice removal block 110 is implemented on a processor configured to perform the functions described above. In one embodiment, pitch detection block 106 is implemented on a processor configured to perform the functions described above. In one embodiment, system 100 is implemented on a processor configured to perform the functions described above.

Figure 2:
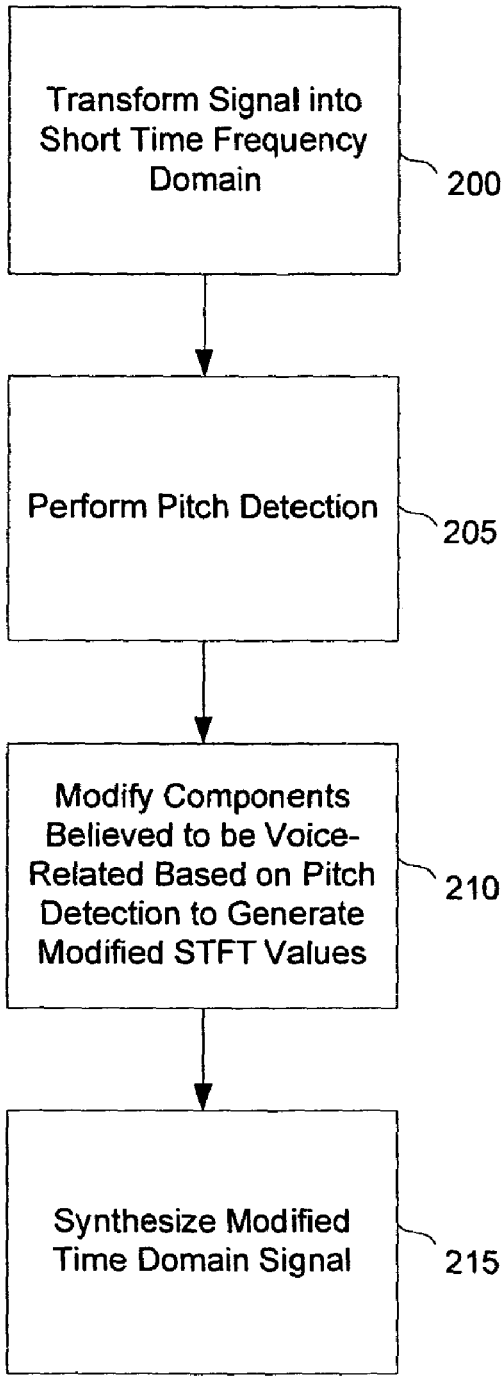
FIG. 2 is a flowchart illustrating a method used in one embodiment to remove or amplify one or more components of an audio signal.

FIG. 2 is a flowchart illustrating a method used in one embodiment to remove or amplify one or more components of an audio signal. In step 200, the audio signal is transformed into a short time frequency domain. In one embodiment, the audio signal may comprise a stereo signal comprising a left stereo channel and a right stereo channel, and in one such embodiment step 200 comprises transforming the left stereo channel and the right stereo channel separately into left and right channel short time frequency domain spectra, as shown in FIG. 1. In step 205, the pitch of the voice information in the audio signal is detected using one of many methods well known in the art. In one embodiment, the frequency domain spectra from step 200 are used to detect the pitch of the voice information in the signal. In one embodiment, it is assumed that the voice component typically will be associated with the most prominent pitch associated with the audio signal, and in one such embodiment the most prominent pitch in the audio signal is detected (monophonic approach). In another embodiment, it is assumed that the voice component typically will be associated with the first or second most prominent pitch associated with the audio signal, and in one such embodiment the first and second most prominent pitches in the audio signal are detected (duophonic approach).

Based at least in part on the pitch or pitches detected in step 205, portions of the frequency domain spectra believed to be voice-related are modified in step 210 to produce modified frequency domain spectra. In one embodiment, portions of the frequency domain spectra believed to be voice related comprise a range of frequency bins located around each harmonic of the detected pitch or pitches. In one embodiment, the portions believed to be voice-related are amplified. In one embodiment, the portions believed to be voice-related are removed. In one embodiment, a gain is used to modify the frequency domain spectra. In one such embodiment, as described more fully below, the gain may vary based at least in part on the degree of similarity between the left and right channels and/or other factors.

In step 215, a modified time domain signal is synthesized from the modified short time frequency domain spectra. In one embodiment, step 210 comprises generating modified spectra for the left and right stereo channels, as in FIG. 1, and step 215 comprises synthesizing separate time domain signals for the left and right stereo channels.

The pitch of the voice information in an audio signal can be detected using one of many techniques well known in the art. In one embodiment, it is assumed that the voice component will have the most prominent pitch (monophonic approach). In another embodiment, it is assumed that the voice component will have the first or second most prominent pitch (duophonic approach). In one embodiment, the autocorrelation of the spectral magnitude of the stereo signal is used. The autocorrelation typically exhibits a peak at the most prominent pitch. In one embodiment, a plurality of frequency domain combs is used where each comb is associated with a candidate pitch frequency. The spectral magnitude of the stereo signal is cross-correlated with the frequency domain combs.

Figure 3:
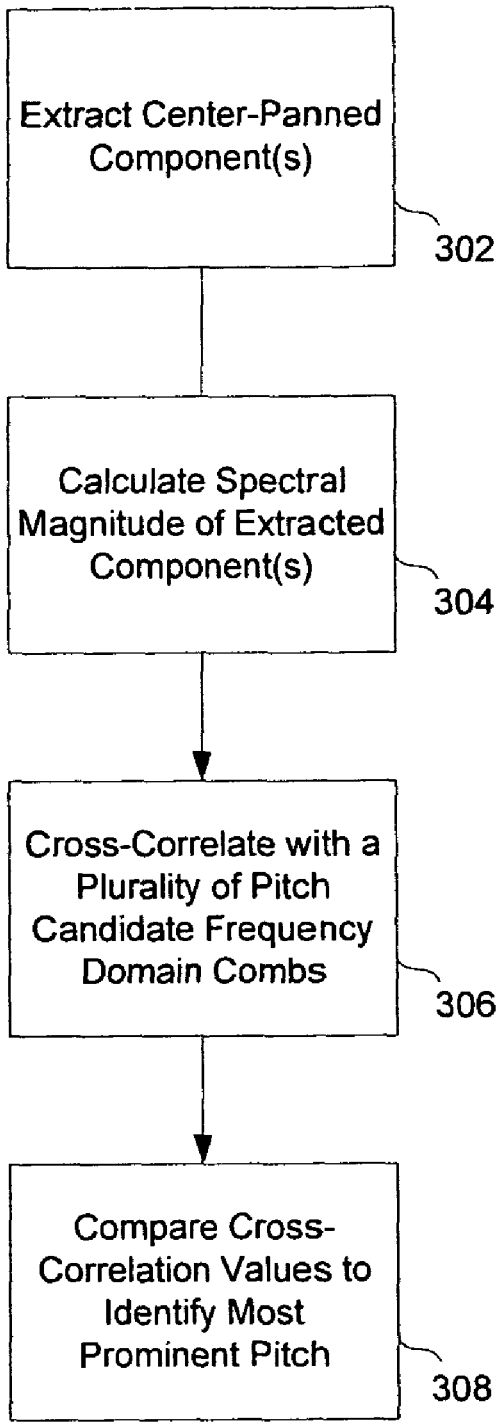
FIG. 3 is a flowchart illustrating a method used in one embodiment that uses frequency domain combs to perform pitch detection of an audio signal (step 205).

FIG. 3 is a flowchart illustrating a method used in one embodiment that uses frequency domain combs to perform pitch detection of an audio signal (step 205). In step 302, the center-panned component(s) of the audio signal are extracted. In step 304, the spectral magnitude M(u,k) of the extracted component(s) of the audio signal is calculated. In one embodiment, step 302 is not performed and $M(u,k)=|S_R(u,k)+S_L(u,k)|$, i.e., the magnitude of the combined left and right channel signals is determined in step 304. In one embodiment, the spectral magnitude is compressed using a compression function (for example, a logarithmic function, a square root function, or an inverse hyperbolic sine function).

In step 306, a plurality of pitch candidates $\{P_m\}$ is selected (for example, every Hz between 80 Hz and 200 Hz). Frequency domain combs C of each pitch candidate are cross-correlated with the spectral magnitude. In one embodiment, the cross-correlation function is defined as $$C(P_m) = \sum_{i=0}^{I(P_m)} M(k(i))$$

where k(i) corresponds to the STFT bin closest to the $i^{th}$ harmonic of the pitch $P_m$. The sum is carried out up to $i=I(P_m)$ (i.e., for harmonics below a certain limit in Hz, such as 6 kHz).

The cross-correlation typically exhibits a large peak at the most prominent pitch and smaller peaks at multiples and submultiples of the most prominent pitch. In step 308, the location of the maximum value of $C(P_m)$ is identified as the most prominent pitch for that frame. In one embodiment, it is assumed that the voice component will have the most prominent pitch.

In some embodiments, a voiced/unvoiced decision is obtained, using techniques well known in the art to determine whether or not a voice component is present. In one embodiment, if the most prominent pitch is outside a predefined range (for example from 80 Hz to 300 Hz for a male singer, or from 200 Hz to 1 kHz for a female singer), the algorithm assumes that no voice is present.

In one embodiment, the voiced/unvoiced decision is obtained by comparing the maximum correlation to a predefined threshold. If the maximum correlation is above the threshold, the decision is that the location of the maximum correlation is the voice pitch. If the maximum correlation is below the threshold, the decision is that there is no voice component in the signal. A conservative choice for a threshold is one that biases the decision to be voiced. In one embodiment, if the decision is that there is no voiced information in the signal, system 100 performs no processing (passes input signals $s_L(t)$ and $s_R(t)$ straight to the output).

In one embodiment, pitch detection is performed on a frame-by-frame basis. In some embodiments, previous and future values of the pitch are used to smooth the frame-based estimate via a median filter or a dynamic programming algorithm, both well known in the art. This may help stabilize the voiced/unvoiced decision and remove occasional octave errors.

Figure 4A:
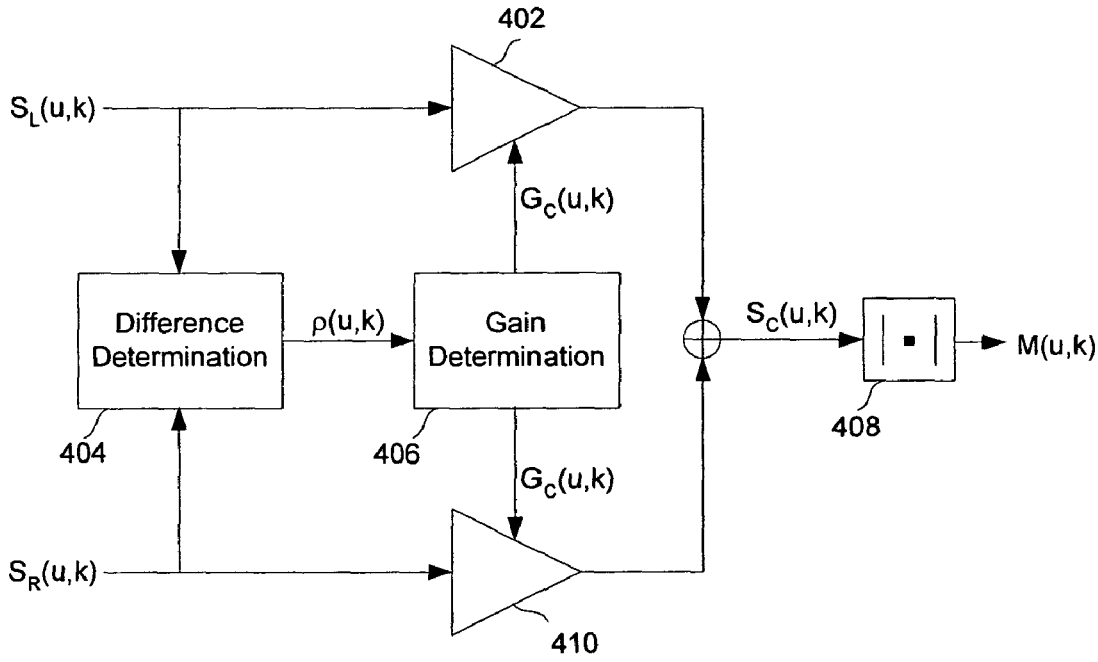
FIG. 4A is a block diagram illustrating a system used in one embodiment to perform step 302 and step 304 in FIG. 3.

FIG. 4A is a block diagram illustrating a system used in one embodiment to perform step 302 and step 304 in FIG. 3. In one embodiment, the audio signal may comprise a stereo signal comprising a left stereo channel and a right stereo channel, and in one such embodiment the left stereo channel and the right stereo channel are transformed separately into left and right channel short time frequency domain spectra, as shown in FIG. 1. The frequency domain spectra of the left and right stereo channels are labeled in FIG. 1 as $S_L(u,k)$ and $S_R(u,k)$, respectively. $S_L(u,k)$ and $S_R(u,k)$ are provided as input to a difference determination block 404.

Difference determination block 404 estimates the degree to which the signal is panned in the center. The output of difference determination block 404 is labeled as ρ(u,k) in FIG. 4. In one embodiment, ρ(u,k) is defined as $$p(u,k) \equiv \frac{|S_L - S_R|^2}{|S_L|^2 + |S_R|^2}$$

A component of the signal that is panned in the center will exhibit a small ρ(u,k) because the left and right channel short time frequency domain spectra $S_L(u,k)$ and $S_R(u,k)$ are similar. In contrast, a component of the signal that is not panned in the center will exhibit a larger ρ(u,k).

ρ(u,k) is provided as input to a gain determination block 406. Gain determination block 406 determines a gain $G_C(u,k)$ as a function of ρ(u,k). $G_C(u,k)$ is appropriately defined so that when it is applied to $S_L(u,k)$ and $S_R(u,k)$, the center-panned components of the signal are extracted. For example, $G_C(u,k)$ may attenuate non-center-panned components of the signal, and thus extract the center-panned components of the signal. In one embodiment, $G_C(u,k)$ is defined as $$G_C(u,k) \equiv \frac{1 - G'_C(u,k)}{1 + G'_C(u,k)}$$

where

-continued $$G'_C(u,k) \equiv \begin{cases} \left(\frac{\rho(u,k)}{\rho_0}\right)^{\alpha} \text{ for } \rho(u,k) \le \rho_0 \\ 1 \text{ for } \rho(u,k) > \rho_0 \end{cases}$$

$\rho_0$ is an arbitrary threshold and $\alpha$ is used to control the behavior of $G_C$ as a function of $\rho$. For example, threshold values between 0.001 and 0.5 and an exponent value $\alpha$=0.7 may be used. This choice of $G_C$ will attenuate any signal not panned to the center, and thus extract the center-panned components of the signal.

The gains $G_C(u,k)$ provided as output of gain determination block 406 are provided as input to amplifier 402 and amplifier 410. $S_L(u,k)$ and $S_R(u,k)$ are provided as inputs to amplifier 402 and amplifier 410, respectively. Amplifier 402 applies the respective gains $G_C(u,k)$ to left channel short time frequency domain spectra $S_L(u,k)$ to which they correspond. Likewise, amplifier 410 applies the gains $G_C(u,k)$ to $S_R(u,k)$. The outputs of amplifier 402 and amplifier 410 are combined and the sum $S_C(u,k)$ is provided as input to a spectral magnitude block 408.

Spectral magnitude block 408 is a block used in one embodiment to perform step 304 in FIG. 3. Spectral magnitude block 408 calculates the spectral magnitudes M(u,k) of the extracted component(s) of the audio signal. In one embodiment, $M(u,k)=|S_C(u,k)|$. In one embodiment, the spectral magnitude is compressed using a compression function F (for example, a logarithmic function, a square root function, or an inverse hyperbolic sine function). In one embodiment, $M(u,k)=F(|S_C(u,k)|)$.

Figure 4B:
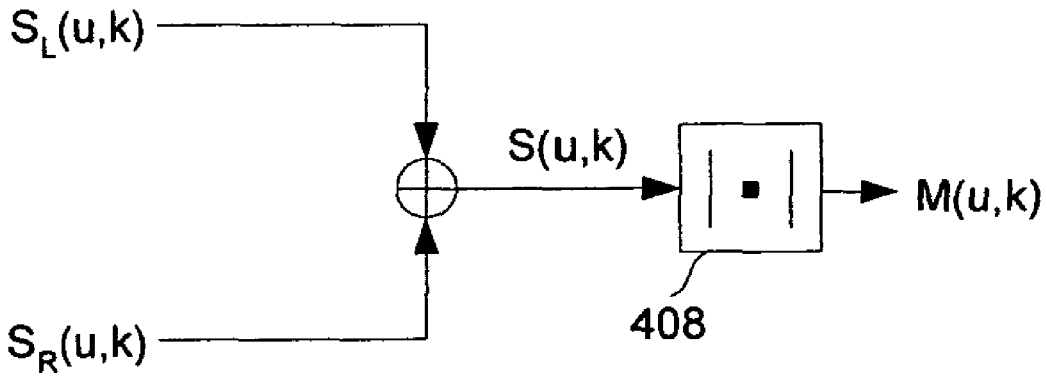
FIG. 4B is a block diagram illustrating a system used in one embodiment to perform step 304 in FIG. 3.

FIG. 4B is a block diagram illustrating a system used in one embodiment to perform step 304 in an embodiment in which pitch detection is performed on the combined left and right channel signals, as opposed to on the extracted center-panned signal, such as in an embodiment in which step 302 is of FIG. 3 is omitted, as described above. In one embodiment, the audio signal may comprise a stereo signal comprising a left stereo channel and a right stereo channel, and in one such embodiment the left stereo channel and the right stereo channel are transformed separately into left and right channel short time frequency domain spectra, as shown in FIG. 1. The frequency domain spectra of the left and right stereo channels are labeled in FIG. 1 as $S_L(u,k)$ and $S_R(u,k)$, respectively. $S_L(u,k)$ and $S_R(u,k)$ are summed and provided as input to spectral magnitude block 408. Spectral magnitude block 408 is described above with respect to FIG. 4A.

Figure 5A:
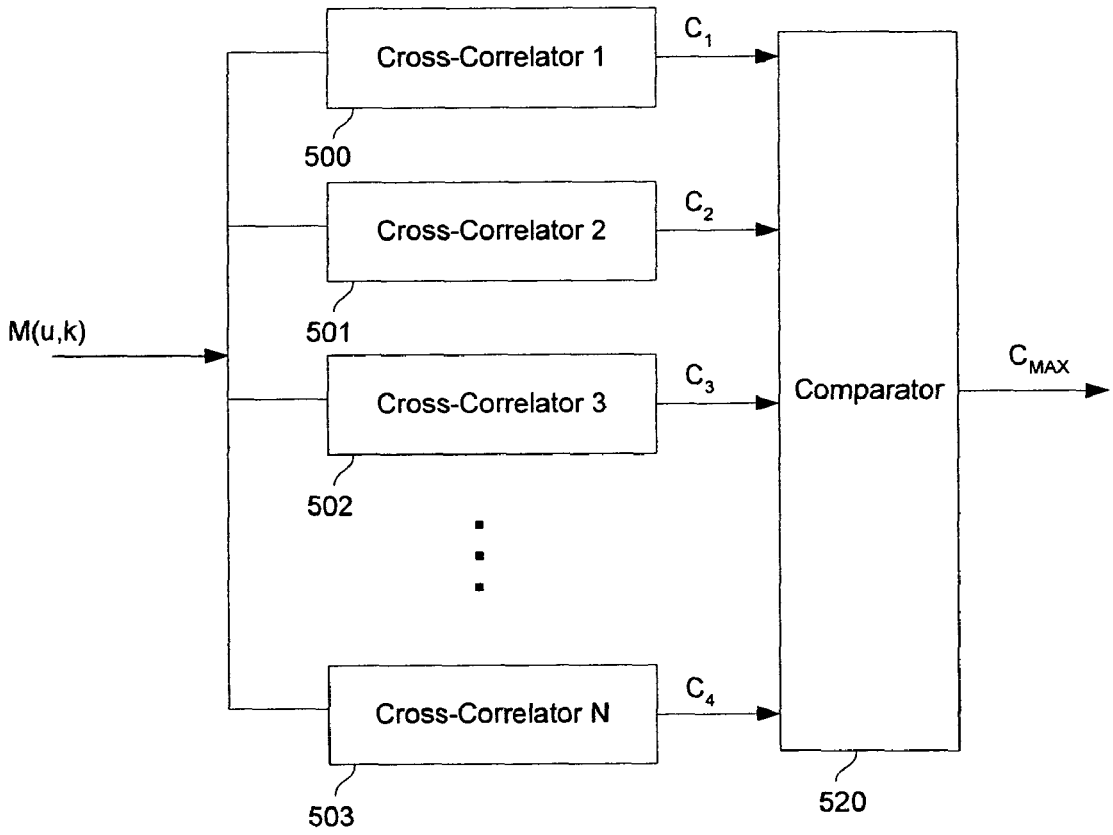
FIG. 5A is a block diagram illustrating a system used in one embodiment to perform step 306 and step 308 in FIG. 3.

FIG. 5A is a block diagram illustrating a system used in one embodiment to perform step 306 and step 308 in FIG. 3. A plurality of pitch candidates $\{P_m\}$ is selected. Spectral magnitude values M(u,k), determined in one embodiment as described above in connection with FIG. 4A and in one alternative embodiment as described above in connection with FIG. 4B, are provided as input to N cross-correlator blocks 500-503. In one embodiment, for each frame u, each cross-correlator block cross-correlates the spectral magnitude values M(u,k) with a frequency domain comb associated with a pitch candidate to produce cross-correlation values $C_1$ through $C_N$, where $C_m=C(P_m)$. Each cross-correlator block 500-503 provides a cross-correlation value as input to a comparator block 520. Comparator block 520 selects the maximum cross-correlation value $C_{MAX}$. The pitch associated with $C_{MAX}$ is the most prominent pitch and assumed to be the voice component.

Figure 5B:
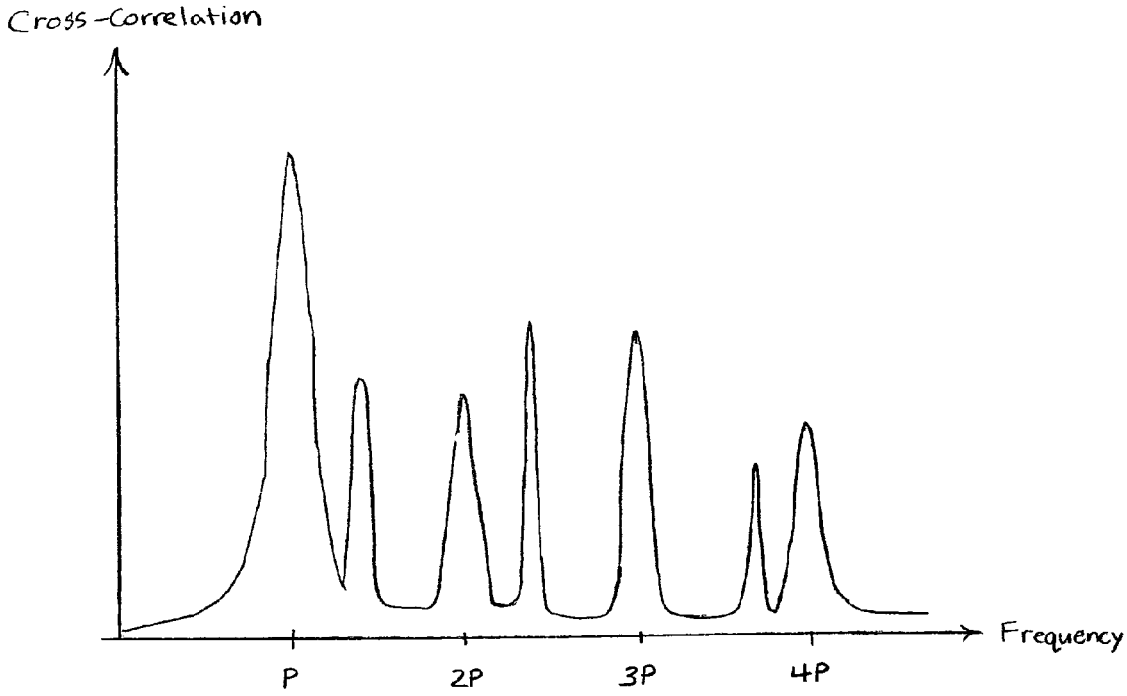
FIG. 5B is a plot illustrating the cross correlation values $C_m$ as a function of frequency for an audio signal.

FIG. 5B is a plot illustrating the cross correlation values $C_m$ as a function of frequency for an audio signal. The cross-correlation values exhibit a large peak at the most prominent pitch and smaller peaks at multiples (and submultiples, not shown in FIG. 5B) of the most prominent pitch. In FIG. 5B, the most prominent pitch is P and its harmonics (multiples) are 2P, 3P, and 4P. In one embodiment, the most prominent pitch P is assumed to be the voice component.

Figure 6A:
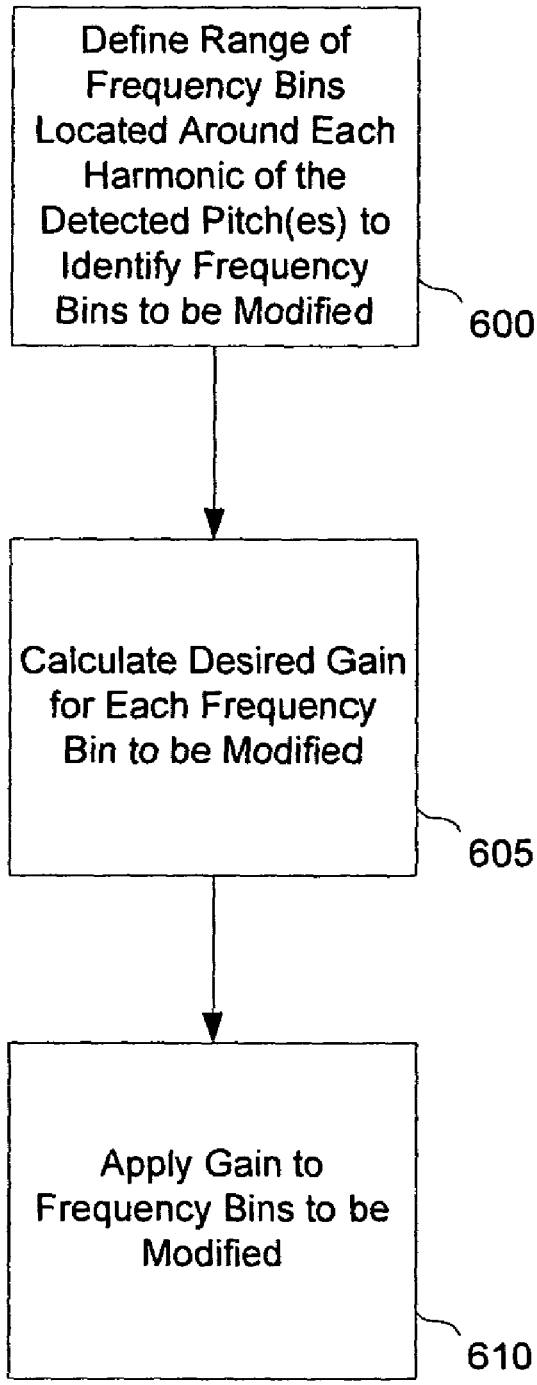
FIG. 6A is a flowchart illustrating a method used in one embodiment to modify portions of frequency domain spectra believed to be voice-related based on a detected pitch or pitches (step 210).

FIG. 6A is a flowchart illustrating a method used in one embodiment to modify portions of frequency domain spectra believed to be voice-related based on a detected pitch or pitches (step 210). In step 600, a range of frequency bins located around each harmonic of the detected pitch or pitches are identified as bins that will be modified. The frequency ranges represented by the ranges of frequency bins defined in step 600 are referred to herein as "harmonic regions". In one embodiment, the harmonic regions comprise a range of short time Fourier transform frequency bins around each harmonic. These regions may include several bins on each side of the harmonic bin.

Figure 6B:
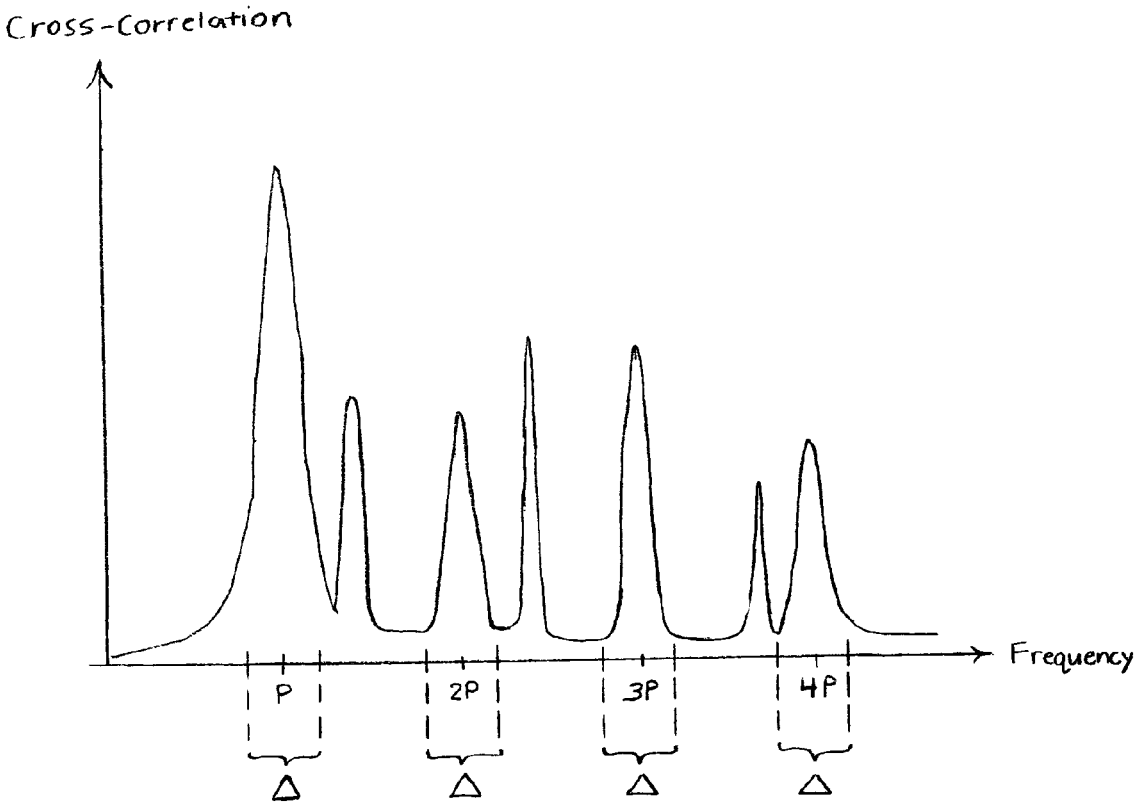
FIG. 6B is the plot of FIG. 5B with harmonic regions each of length Δ labeled.

FIG. 6B is the plot of FIG. 5B with harmonic regions each of length $\Delta$ labeled. As discussed above, the harmonic regions are the portions of the signal to be modified. In one embodiment, the harmonic regions each have the same length $\Delta$. In other embodiments, the harmonic regions may have different lengths.

As further discussed below, in one embodiment, a gain is calculated for the center (or harmonic) bin of each harmonic region and the same gain so calculated is applied to all of the bins comprising the corresponding harmonic region, so there is one gain for each harmonic region. In one alternative embodiment, a gain is calculated only for the center bin of the harmonic region of the fundamental frequency P, and this same gain is applied to all the harmonic regions.

Referring further to FIG. 6A, in step 605, a gain is calculated for each frequency bin or set of frequency bins to be modified. In one embodiment, a gain is calculated for each short time Fourier transform frequency bin to be modified. In one such embodiment, the gain is zero for portions associated with a center-panned component and nonzero (e.g., one) for other portions (voice removal). Alternatively, the gain may be nonzero (e.g., greater than one) when a component of the signal is center-panned and one when it is not (voice amplification).

In one embodiment, the gain may vary based on the extent to which the left and right channels are center-panned (i.e., the degree of similarity between the left and right channels) and/or other factors. Components of the frequency spectra of the left and right channels that are similar are more center-panned. If voice-related signals are center-panned, attenuating similar components of the left and right channels typically attenuates voice components of the audio signal. In one such embodiment, the gain is defined as:

$$G(u,k) \equiv \begin{cases} \left(\frac{\rho(u,k)}{\rho_0}\right)^{\alpha} \text{ for } \rho(u,k) \le \rho_0 \\ 1 \text{ for } \rho(u,k) > \rho_0 \end{cases} \quad (1)$$

where $$p(u,k) \equiv \frac{|S_L - S_R|^2}{|S_L|^2 + |S_R|^2} \quad (2)$$

$\rho_0$ is an arbitrary threshold and $\alpha$ is used to control the behavior of the gain G as a function of the channel comparison function $\rho$ (which has a low value when the channels are nearly the same and a value of zero when $S_L=S_R$). For example, threshold values between 0.001 and 0.5 and an exponent value $\alpha$=0.7 may be used. This choice of G will attenuate any signal panned to the center.

In one embodiment, the intent is to amplify the voice rather than attenuate it. As used herein, the term "amplify" as applied to a component of an audio signal means to increase the magnitude of that component relative to other components of the audio signal. In one embodiment, the component is amplified by attenuating portions of the audio signal not associated with the component while leaving portions associated with the component unchanged (or substantially unchanged). In one such embodiment, the gain may be defined as:

$$G'(u,k) \equiv \frac{1-G(u,k)}{1+G(u,k)}$$

This choice of gain G' will attenuate any components panned away from the center, and thereby amplify the center-panned component relative to such attenuated components. In one alternative embodiment, amplification is achieved by increasing the magnitude of portions of the audio signal associated with the component to be amplified while leaving portions not associated with the component unchanged (or substantially unchanged).

In one embodiment, time-domain smoothing of the gain values is performed to avoid erratic gain variations that can be perceived as a degradation of the signal quality.

In step 610 of the process shown in FIG. 6, the gains determined in step 605 are applied to the harmonic regions. In one embodiment, outside the harmonic regions, the gain is set to 1 when voice removal is desired, and a value between zero and one when amplification of the voice component relative to other components is desired. In one embodiment, the gain is smoothed at the boundaries of the harmonic regions as described above. In one embodiment, the gain is applied to a selected set of short time Fourier transform frequency bins to be modified, as described above. In one such embodiment, rather than calculating a gain for each bin, a gain is calculated for one bin (typically the center bin) in each harmonic region and the same gain applied to all the bins in the harmonic region. Alternatively, rather than calculating a gain for each harmonic, a gain may be calculated for one bin (typically the center bin) of the harmonic region located around the fundamental frequency and the gain applied to all the harmonic regions.

Figure 7:
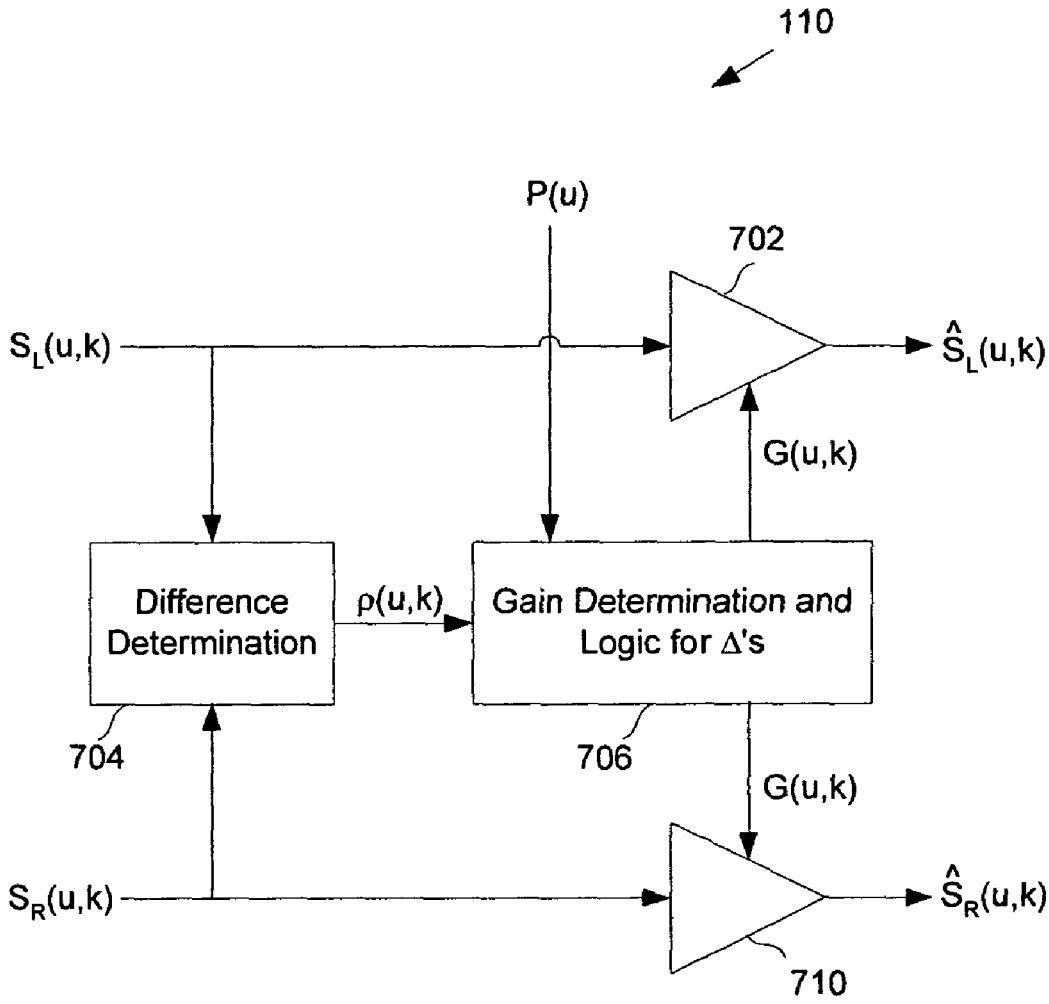
FIG. 7 is a block diagram illustrating one embodiment of voice removal block 110 in FIG. 1.

FIG. 7 is a block diagram illustrating one embodiment of voice removal block 110 in FIG. 1. In one embodiment, the audio signal may comprise a stereo signal comprising a left stereo channel and a right stereo channel, and in one such embodiment the left stereo channel and the right stereo channel are transformed separately into left and right channel short time frequency domain spectra, as shown in FIG. 1. The frequency domain spectra of the left and right stereo channels are labeled in FIG. 1 as $S_L(u,k)$ and $S_R(u,k)$, respectively. $S_L(u,k)$ and $S_R(u,k)$ are provided as input to a difference determination block 704.

Difference determination block 704 estimates the degree to which the signal is panned in the center. The output of difference determination block 704 is labeled as $\rho(u,k)$ in FIG. 7. In one embodiment, $\rho(u,k)$ is defined as in Equation 2.

For a frequency bin associated with a component of the signal that is panned in the center, the value of the difference function $\rho(u,k)$ will be small (or zero) because the left and right channel short time frequency domain spectra $S_L(u,k)$ and $S_R(u,k)$ are similar (or the same). In contrast, for a frequency bin associate with a component of the signal that is not panned in the center, the value of $\rho(u,k)$ will be greater.

The difference function values $\rho(u,k)$ are provided as input to a gain determination block 406. Gain determination block 706 determines, for each frequency bin for which a gain is needed, a gain G(u,k) as a function of $\rho(u,k)$. G(u,k) is appropriately defined so that when it is applied to $S_L(u,k)$ and $S_R(u,k)$, the desired result is obtained. For example, G(u,k) may attenuate or amplify the center-panned components of the signal, and thus remove or amplify voice. As discussed above, in one embodiment, G(u,k) is defined as in Equation 1.

The most prominent pitch values P(u) provided as output of pitch detection block 106 also are provided as input to gain determination block 706. Gain determination block 706 includes logic to identify the harmonic regions associated with the most prominent P(u), as described above. In one embodiment, gain determination block 706 calculates a gain for the harmonic regions only. For example, in one embodiment the gain is one by default for frequencies that are not within a harmonic region and the gain is G(u,k) for frequencies that are within the harmonic region. In one embodiment, a gain is determined for each short time Fourier transform frequency bin in each harmonic region. In one embodiment, rather than calculating a gain for each bin, a gain is calculated for one bin (typically the center bin) in each harmonic region so that the same gain is associated with all the bins in the harmonic region. Gains outside the harmonic regions are set to one.

The output of gain determination block G is provided as input to amplifier 702 and amplifier 710. $S_L(u,k)$ and $S_R(u,k)$ are provided as inputs to amplifier 702 and amplifier 710, respectively. Amplifier 702 applies the gains G(u,k) to the corresponding values $S_L(u,k)$ to produce modified left channel spectra $\hat{S}_L(u,k)$. Likewise, amplifier 710 applies the gains G(u,k) to the corresponding values $S_R(u,k)$ to produce modified right channel spectra $\hat{S}_R(u,k)$.

The voice pitch may not be the most prominent pitch in an audio signal. In one embodiment, monophonic, duophonic, or polyphonic pitch detection techniques may be used. Duophonic or polyphonic pitch detection techniques may be desirable if more than one pitch is to be modified (for example, if the most prominent pitch is not voice-related).

For example, some tracks have a lot of instruments panned near the center, with a voice signal that is not very prominent. In these frames, the prominent instrument rather than the voice may be attenuated if monophonic pitch detection is used. Duophonic pitch detection detects the two most prominent pitches in an audio signal and may be preferred when the voice pitch is one of the two strongest pitches in an audio signal. In other embodiments, polyphonic pitch detection (in which more than two pitches are detected) may be preferred.

Figure 8:
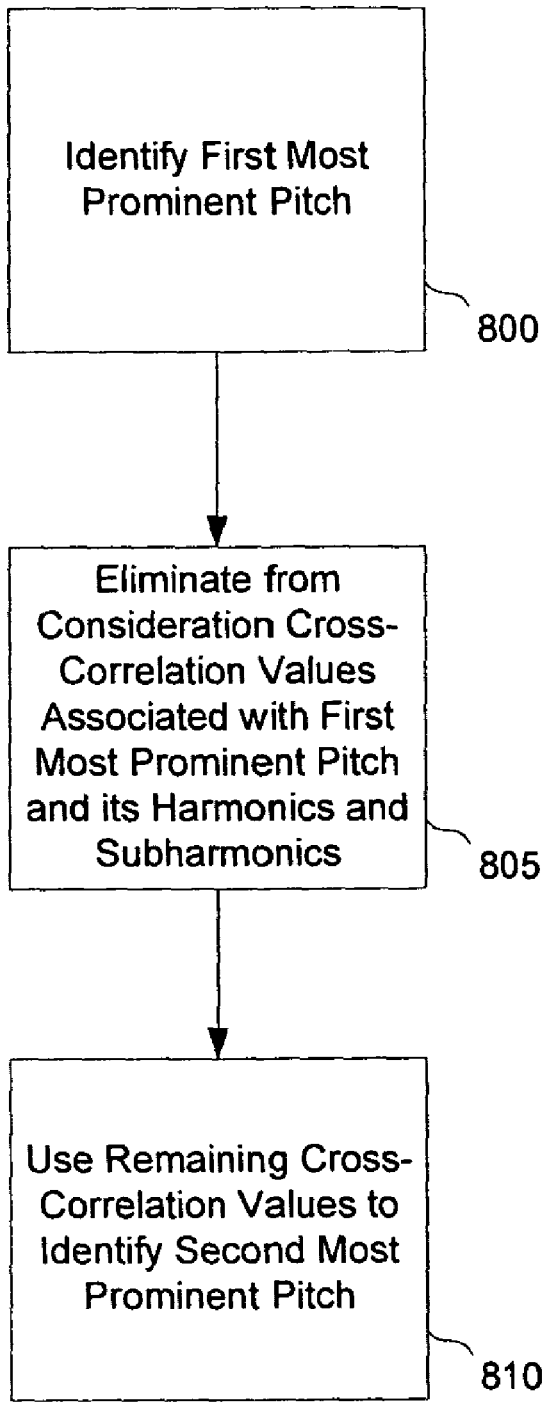
FIG. 8 is a flowchart illustrating a duophonic technique used in one embodiment to perform pitch detection of an audio signal.

FIG. 8 is a flowchart illustrating a duophonic technique used in one embodiment to perform pitch detection of an audio signal. In one embodiment, such duophonic pitch detection is performed in step 205 of the process shown in FIG. 2. In step 800, the first most prominent pitch is identified. In one embodiment, the first most prominent pitch is identified according to the techniques described above in connection with FIG. 3 (monophonic technique). In step 805, the cross-correlation values are zeroed out around the most prominent pitch, its multiples (harmonics) and submultiples, to remove cross-correlation values associated with the most prominent pitch from further consideration. In step 810, the remaining cross-correlation values are used to identify the second most prominent pitch. In one embodiment, step 308 of the process shown in FIG. 3 is performed using the remaining cross-correlation values and the pitch associated with the maximum value among the remaining cross-correlation values is identified as the second most prominent pitch.

As with the monophonic pitch algorithm, in some embodiments, a voiced/unvoiced decision may be used to determine whether or not the first or second most prominent pitch belongs to the voice component.

In one embodiment, harmonic regions of the first and second most prominent pitches are modified. In one embodiment, steps 600, 605, and 610 are repeated to modify the harmonic regions of the first and second most prominent pitches, respectively.

Figure 9:
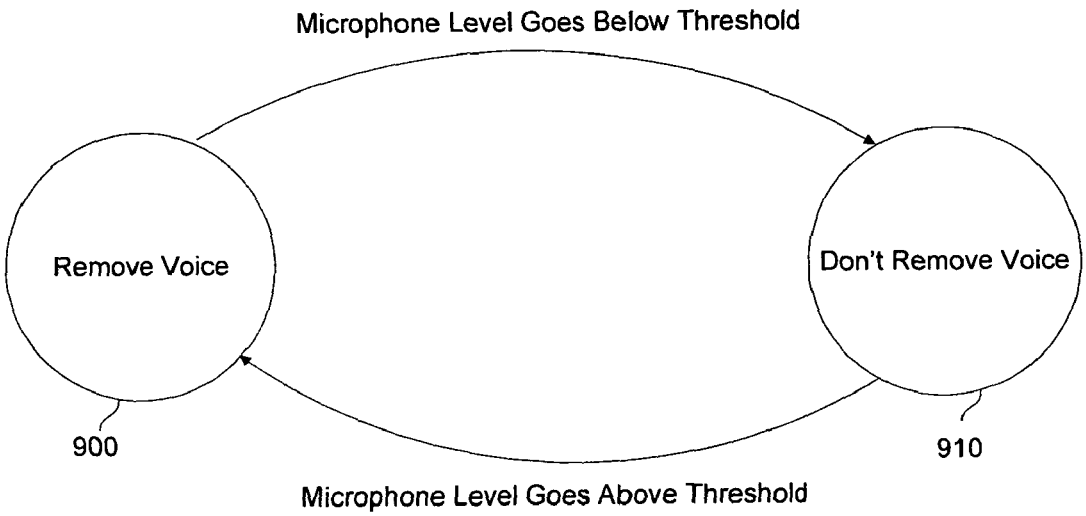
FIG. 9 is a state diagram illustrating a duck technique.

FIG. 9 is a state diagram illustrating a duck technique. In a karaoke or similar setting, the duck technique results in an improvement in the perceived quality of the audio track and allows the user to rehearse more easily. The duck technique monitors the voice input from a user as measured at a microphone being used by the user to sing or speak along with the rendered audio signal, and only attenuates the recorded voice when the user is speaking or singing. As a result, the recording is not altered unless the user speaks or sings into the microphone. The duck technique includes a "remove voice" state 900 and a "don't remove voice" state 910. If the current state is "remove voice" state 900, the recorded voice component is removed. If the current state is "don't remove voice" state 905, the recorded voice component is not removed. The current state transitions from "remove voice" state 900 to "don't remove voice" state 905 when the microphone level goes below a threshold (e.g., the user has stopped signing or speaking, or is singing or speaking only softly). The current state transitions from "don't remove voice" state 905 to "remove voice" state 900 when the microphone level goes above a threshold. In one embodiment, the two thresholds are the same. In one embodiment, the two thresholds are different. In one embodiment, the two thresholds may be the same or different, as the user prefers. In one embodiment, the user may control the threshold value(s) via a user input or control. In one embodiment, the duck feature may be disabled.

Figure 10:
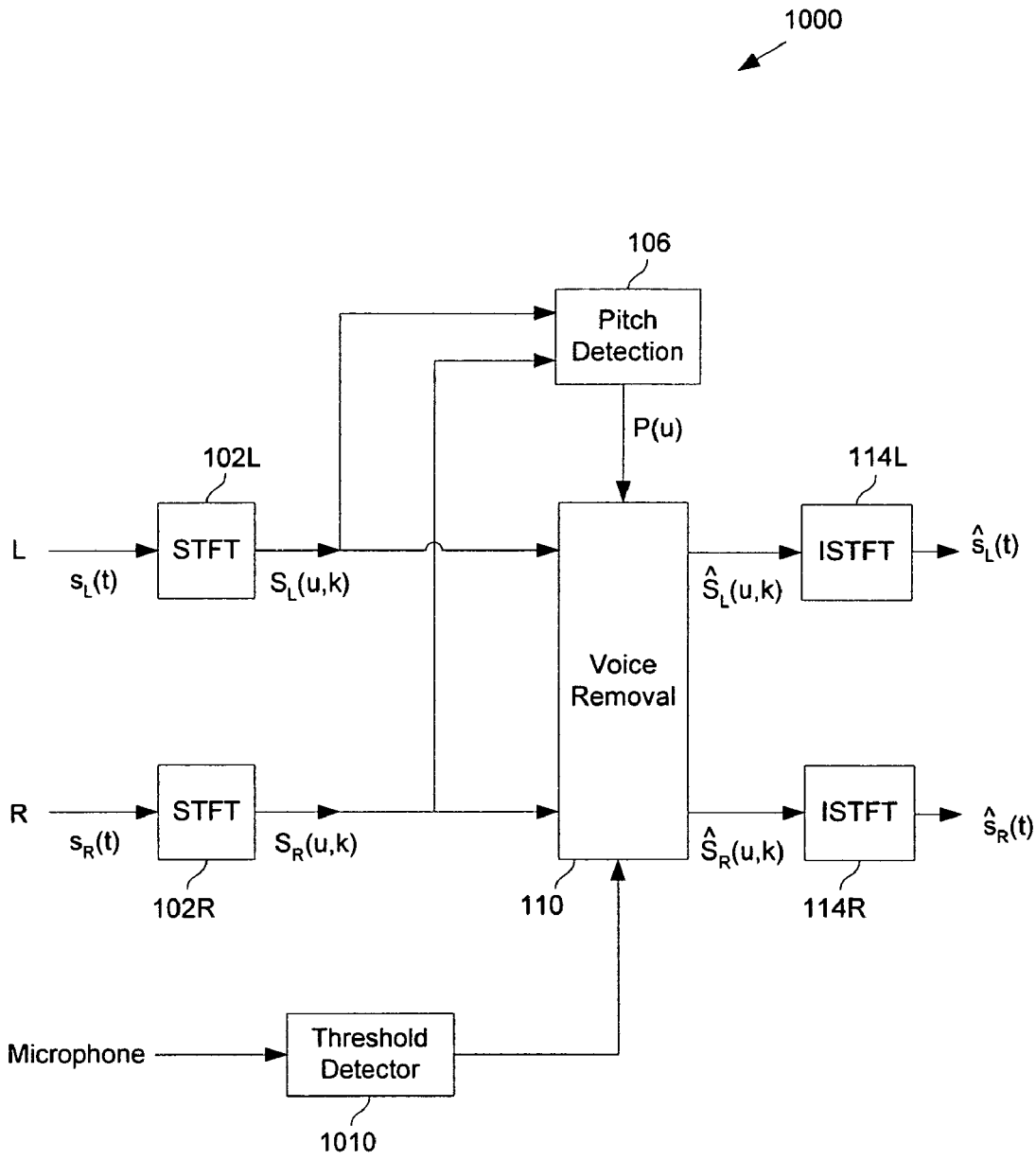
FIG. 10 is a block diagram illustrating a system used in one embodiment to remove or amplify one or more components from a stereo recording incorporating an embodiment of a duck technique.

FIG. 10 is a block diagram illustrating a system used in one embodiment to remove or amplify one or more components from a stereo recording incorporating an embodiment of a duck technique. System 1000 is system 100 modified to include a threshold detector 1010. The user speaks or sings into a microphone. When the microphone level is below a prescribed threshold, the threshold detector 1010 sends a corresponding control signal to voice removal block 110 and in response voice removal block 110 does not modify frequency spectra $S_L(u,k)$ and $S_R(u,k)$ to remove voice. When the microphone level is above a prescribed threshold, the threshold detector 1010 sends a corresponding control signal to voice removal block 110 and in response voice removal block 110 modifies the frequency spectra $S_L(u,k)$ and $S_R(u,k)$ as described above to remove voice. As noted above, the threshold for de-activating voice removal block 110 may not be the same as the threshold for activating voice removal block 110, depending on the embodiment.

In one alternative embodiment, not shown in FIG. 10, when the microphone level is below the prescribed threshold, a control signal is sent by threshold detector 1010 to disable both the voice removal block 110 and pitch detection block 106, and neither voice removal nor pitch detection is performed. In one alternative embodiment, not shown in FIG. 10, system 1000 performs no processing when the microphone level is below the prescribed threshold. In this embodiment, input signals $s_L(t)$ and $s_R(t)$ bypass system 1000 and are passed straight to the output.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method for modifying an audio signal with a pitch-based signal component removal device, comprising:

detecting a first most prominent pitch associated with the audio signal including:

transforming the audio signal into a time frequency domain to generate short time frequency spectra for the audio signal;

obtaining a plurality of pitch candidate frequency domain combs associated with a plurality of pitch candidates;

performing a cross-correlation in the frequency domain using information associated with the short time frequency spectra and the plurality of pitch candidate frequency domain combs in generating cross-correlation values; and identifying the pitch candidate associated with a first maximum value among the cross-correlation values as the first most prominent pitch;

detecting a second most prominent pitch associated with the audio signal by removing cross-correlation values associated with the first most prominent pitch from consideration and identifying the pitch candidate associated with a second maximum value among the remaining cross-correlation values as the second most prominent pitch; and in the event the second most prominent pitch is associated with voice, modifying in the audio signal a portion that is associated with the second most prominent pitch.

2. The method of claim 1, wherein modifying comprises removing from the signal said portion that is associated with the detected pitch.

3. The method of claim 2, wherein removing comprises attenuating said portion that is associated with the detected pitch.

4. The method of claim 3, wherein attenuating comprises partially attenuating said portion that is associated with the detected pitch.

5. The method of claim 1, wherein transforming the audio signal into a time frequency domain comprises processing the audio signal using a subband filter bank.

6. The method of claim 5, wherein transforming the audio signal into a time frequency domain comprises applying the short time Fourier transform to the signal.

7. The method of claim 5, wherein transforming the audio signal into a time frequency domain comprises performing a wavelet transform.

8. The method of claim 1, wherein transforming the audio signal into a time frequency domain comprises generating short time frequency spectra for the audio signal and wherein the step of modifying comprises modifying portions of the short time frequency spectra that are associated with the detected pitch to generate modified short time frequency spectra.

9. The method of claim 8, further comprising using said modified short time frequency spectra to synthesize a modified time-domain audio signal.

10. The method of claim 1, wherein detecting a pitch comprises detecting a pitch believed to be associated with a voice component.

11. The method of claim 1, wherein detecting a pitch comprises detecting a plurality of pitches.

12. The method of claim 1, wherein detecting a pitch comprises extracting a center-panned signal from the audio signal and processing said extracted center-panned signal to detect the pitch.

13. The method of claim 1, further comprising deciding whether the detected pitch is associated with a voice component.

14. The method of claim 13, further comprising performing said step of modifying only if it is decided that the detected pitch is associated with a voice component.

15. The method of claim 13, wherein deciding whether the detected pitch is associated with a voice component comprises comparing a value associated with the detected pitch with a prescribed threshold value.

16. The method of claim 15, wherein the value comprises a cross-correlation value.

17. The method of claim 16, wherein the cross-correlation value comprises a measure of the extent to which the audio signal correlates with a signal associated with a pitch candidate.

18. The method of claim 1, wherein detecting a pitch comprises:

determining spectral magnitude values for said short time frequency spectra; and cross-correlating includes cross-correlating the spectral magnitude values with a plurality of pitch candidate frequency domain combs.

19. The method of claim 18, wherein cross-correlating the spectral magnitude values with a plurality of pitch candidate frequency domain combs yields a cross-correlation value associated with each pitch candidate and the pitch candidate having the highest cross-correlation value is identified as the detected pitch.

20. The method of claim 1, wherein modifying comprises removing from the signal said portion that is associated with the detected pitch by applying a gain to said portion that is associated with the detected pitch.

21. The method of claim 1, wherein modifying comprises identifying said portion associated with the detected pitch.

22. The method of claim 21, wherein identifying said portion associated with the detected pitch comprises:

transforming the audio signal into a time frequency domain; and selecting for modification a frequency bin associated with the detected pitch.

23. The method of claim 22, wherein:

modifying further comprises applying a gain to said portion that is associated with the detected pitch; and the gain is determined at least in part based on the extent to which the frequency bin is associated with a center-panned component of the audio signal.

24. The method of claim 23, wherein the audio signal comprises a left channel signal and a right channel signal and wherein the extent to which the frequency bin is associated with a center-panned component of the audio signal is determined by comparing the left channel frequency spectra associated with the frequency bin with the right channel frequency spectra associated with the frequency bin.

25. The method of claim 22, wherein selecting for modification comprises selecting a frequency bin closest to the detected pitch.

26. The method of claim 22, wherein selecting for modification comprises selecting a frequency bin closest to a harmonic of the detected pitch.

27. The method of claim 22, wherein selecting for modification comprises selecting a frequency bin closest to a subharmonic of the detected pitch.

28. The method of claim 23, wherein selecting for modification comprises selecting a range of frequency bins comprising a frequency bin closest to a harmonic of the detected pitch.

29. The method of claim 28, wherein the harmonic is the first harmonic.

30. The method of claim 28, wherein modifying comprises applying a gain to each frequency bin in said range of frequency bins.

31. The method of claim 30, wherein a separate gain is calculated for each frequency bin in the range of frequency bins.

32. The method of claim 31, wherein the gain for each respective frequency bin is determined at least in part based on the extent to which the frequency bin is associated with a center-panned component of the audio signal.

33. The method of claim 32, wherein the audio signal comprises a left channel signal and a right channel signal and wherein the extent to which a frequency bin is associated with a center-panned component of the audio signal is determined by comparing the left channel frequency spectra associated with the frequency bin with the right channel frequency spectra associated with the frequency bin.

34. The method of claim 30, wherein the same gain is applied to each frequency bin in the range of frequency bins.

35. The method of claim 34, wherein the gain is determined based on a selected frequency bin in the range of frequency bins.

36. The method of claim 35, wherein the selected frequency bin is the frequency bin closest to the harmonic of the detected pitch.

37. The method of claim 35, wherein the gain is determined at least in part based on the extent to which the selected frequency bin is associated with a center-panned component of the audio signal.

38. The method of claim 1, wherein modifying comprises amplifying said portion that is associated with the detected pitch relative to portions not associated with the detected pitch.

39. The method of claim 38, wherein amplifying said portion that is associated with the detected pitch relative to portions not associated with the detected pitch comprises enhancing said portion that is associated with the detected pitch while leaving said portions not associated with the detected pitch unchanged.

40. The method of claim 38, wherein amplifying said portion that is associated with the detected pitch relative to portions not associated with the detected pitch comprises leaving said portion that is associated with the detected pitch unchanged while attenuating said portions not associated with the detected pitch.

41. The method of claim 1, wherein the audio signal is a primary audio signal;

the method further includes monitoring the level of a secondary audio signal;

the method further includes enabling modification of the primary audio signal if the level of the secondary audio signal rises above a first prescribed threshold at a time when the primary audio signal is not being modified; and the method further includes disabling modification of the primary audio signal if the level of the secondary audio signal drops below a second prescribed threshold at a time when the primary audio signal is being modified.

42. The method of claim 41, wherein the secondary audio signal comprises a signal generated by a microphone.

43. The method of claim 41, wherein the first prescribed threshold and the second prescribed threshold are the same.

44. The method of claim 41, wherein disabling processing comprises bypassing a system configured to perform the modification.

45. The method of claim 41, wherein disabling processing comprises bypassing or disabling a component of a system configured to perform the modification.

46. The method of claim 41, wherein the modification comprises: detecting a pitch associated with the primary audio signal; and modifying in the primary audio signal a portion that is associated with the detected pitch.

47. The method of claim 46, wherein:

detecting a pitch comprises detecting a pitch believed to be associated with a voice component; and modifying the audio signal comprises removing said voice component from the audio signal.

48. The method of claim 46, wherein disabling modification comprises bypassing the step of detecting a pitch associated with an audio signal.

49. The method of claim 46, wherein disabling modification comprises bypassing the step of modifying in the audio signal a portion that is associated with the detected pitch.

50. The method of claim 1, wherein removing cross-correlation values associated with the first most prominent pitch includes:

zeroing out the cross-correlation values around the first most prominent pitch, its multiples and submultiples.

51. The method of claim 1 further comprising determining whether the second most prominent pitch is associated with voice.

52. The method of claim 51, wherein determining whether the second most prominent pitch is associated with voice is based at least in part on whether the second most prominent pitch is within a predefined frequency range.

53. The method of claim 51, wherein determining whether the second most prominent pitch is associated with voice is based at least in part on a comparison between a maximum correlation value and a predefined threshold.

54. The method of claim 1 further comprising:

detecting a third most prominent pitch associated with the audio signal; and in the event the third most prominent pitch is associated with voice, modifying in the audio signal a portion that is associated with the third most prominent pitch.

55. The method of claim 1, wherein the audio signal comprises duophonic or polyphonic pitches.

56. A system for modifying an audio signal, comprising:

an input connection configured to receive the audio signal; and a processor configured to:

detect a first most prominent pitch associated with the audio signal, including by:

transforming the audio signal into a time frequency domain to generate short time frequency spectra for the audio signal;

obtaining a plurality of pitch candidate frequency domain combs associated with a plurality of pitch candidates;

performing a cross-correlation in the frequency domain using information associated with the short time frequency spectra and the plurality of pitch candidate frequency domain combs in generating cross-correlation values; and identifying the pitch candidate associated with a first maximum value among the cross-correlation values as the first most prominent pitch;

detect a second most prominent pitch associated with the audio signal by removing cross-correlation values associated with the first most prominent pitch from consideration and identifying the pitch candidate associated with a second maximum value among the remaining cross-correlation values as the second most prominent pitch; and in the event the second most prominent pitch is associated with voice, modify in the audio signal a portion that is associated with the second most prominent pitch.

57. The system of claim 56, wherein:

the audio signal is a primary audio signal;

the input connection is further configured to receive a secondary audio signal; and the processor is further configured to:

monitor the level of the secondary audio signal;

enable modification of the primary audio signal if the level of the secondary audio signal rises above a first prescribed threshold at a time when the primary audio signal is not being modified; and disable modification of the primary audio signal if the level of the secondary audio signal drops below a second prescribed threshold at a time when the primary audio signal is being modified.

58. A system for modifying an audio signal, comprising:

means for detecting a first most prominent pitch associated with the audio signal, including:

transforming the audio signal into a time frequency domain to generate short time frequency spectra for the audio signal;

obtaining a plurality of pitch candidate frequency domain combs associated with a plurality of pitch candidates;

performing a cross-correlation in the frequency domain using information associated with the short time frequency spectra and the plurality of pitch candidate frequency domain combs in generating cross-correlation values; and identifying the pitch candidate associated with a first maximum value among the cross-correlation values as the first most prominent pitch;

means for detecting a second most prominent pitch associated with the audio signal that includes means for removing cross-correlation values associated with the first most prominent pitch from consideration and identifying the pitch candidate associated with a second maximum value among the remaining cross-correlation values as the second most prominent pitch; and means for modifying in the audio signal a portion that is associated with the second most prominent pitch in the event the second most prominent pitch is associated with voice.

59. The system of claim 58, wherein:

the audio signal is a primary audio signal;

the system further includes means for monitoring the level of a secondary audio signal;

the system further includes means for enabling modification of the primary audio signal if the level of the secondary audio signal rises above a first prescribed threshold at a time when the primary audio signal is not being modified; and the system further includes means for disabling modification of the primary audio signal if the level of the secondary audio signal drops below a second prescribed threshold at a time when the primary audio signal is being modified.

60. A computer program product for modifying an audio signal, the computer program product being embodied in a non-transitory computer readable medium and comprising computer instructions for:

detecting a first most prominent pitch associated with the audio signal including:

transforming the audio signal into a time frequency domain to generate short time frequency spectra for the audio signal;

obtaining a plurality of pitch candidate frequency domain combs associated with a plurality of pitch candidates;

performing a cross-correlation in the frequency domain using information associated with the short time frequency spectra and the plurality of pitch candidate frequency domain combs in generating cross-correlation values; and identifying the pitch candidate associated with a first maximum value among the cross-correlation values as the first most prominent pitch;

detecting a second most prominent pitch associated with the audio signal by removing cross-correlation values associated with the first most prominent pitch from consideration and identifying the pitch candidate associated with a second maximum value among the remaining cross-correlation values as the second most prominent pitch; and in the event the second most prominent pitch is associated with voice, modifying in the audio signal a portion that is associated with the second most prominent pitch.

61. The computer program product of claim 60, wherein:

the audio signal is a primary audio signal;

the computer program product includes further computer instructions for monitoring the level of a secondary audio signal;

the computer program product includes further computer instructions for enabling modification of the primary audio signal if the level of the secondary audio signal rises above a first prescribed threshold at a time when the primary audio signal is not being modified; and the computer program product includes further computer instructions for disabling modification of the primary audio signal if the level of the secondary audio signal drops below a second prescribed threshold at a time when the primary audio signal is being modified.

* * * * *